US005546469A

United States Patent [19]

Donahoe

[11] Patent Number: 5,546,469

[45] Date of Patent: Aug. 13, 1996

[54] SOUND TRANSDUCER

[76] Inventor: Danny T. Donahoe, 504 E. Mesquite, Crowley, Tex. 76036

[21] Appl. No.: 290,065

[22] Filed: Aug. 15, 1994

[51] Int. Cl.[6] ..... H04R 25/00

[52] U.S. Cl. ..... 381/152; 381/192

[58] Field of Search ..... 381/86, 87, 88, 381/90, 150, 152, 188, 192, 194, 199, 201, 205; 181/150, 171, 199

[56] References Cited

U.S. PATENT DOCUMENTS

| | | | |
|---|---|---|---|
| 3,311,712 | 3/1967 | Cain | 179/113 |
| 3,366,749 | 1/1968 | Ries | 179/115.5 |
| 3,423,543 | 1/1969 | Kompanek | 179/110 |
| 3,430,007 | 2/1969 | Theilen | 179/115.5 |
| 3,449,531 | 6/1969 | Ashworth | 179/115 |
| 3,524,027 | 8/1970 | Thurston et al. | 179/115.5 |
| 3,567,870 | 3/1971 | Rivera | 179/115.5 |
| 3,609,253 | 9/1971 | Ashworth | 179/115.5 |
| 3,636,281 | 1/1972 | Cozart | 179/181 |
| 3,728,497 | 4/1973 | Komatsu | 179/181 |
| 3,861,495 | 1/1975 | Pearson | 181/163 |
| 4,514,599 | 4/1985 | Yanagishima et al. | 179/181 |
| 4,914,750 | 4/1990 | Lawson | 381/152 |
| 4,926,486 | 5/1990 | Barsumian | 381/152 |
| 4,951,270 | 8/1990 | Andrews | 367/140 |
| 5,115,472 | 5/1992 | Park et al. | 381/152 |
| 5,335,284 | 8/1994 | Lemons | 381/152 |

*Primary Examiner*—Curtis Kuntz
*Assistant Examiner*—Huyen D. Ie
*Attorney, Agent, or Firm*—H. Dennis Kelly; Jeffrey T. Hubbard; Timmons & Kelly

[57] ABSTRACT

A loudspeaker is designed for mounting on a wall and which uses the wall to help generate sound from electrical signals supplied by an amplifier. The magnetic assembly consists of three disk shaped layers, the outer layers being a magnet and a ferromagnetic pole plate, the layers being separated by a spacer made of resilient material. The magnet and spacer both have roughly identical holes which are coaxially aligned. A center pole, on which a voice coil is wound, extends from the pole plate through the hole in the spacer and partially into the hole in the magnet. A frame serves to hold the magnetic assembly and press the magnet against the wall during operation. Electrical signals fed to the voice coil cause the magnet to vibrate against the wall, exciting the wall to create sound energy.

4 Claims, 2 Drawing Sheets

SOUND TRANSDUCER

BACKGROUND OF THE INVENTION

1. Field of the Invention

This invention relates in general to sound reproduction equipment. In particular, the invention relates to loudspeakers for mounting on a surface, such as a wall, and using the wall to generate sound.

2. Description of the Related Art

Electrodynamic loudspeakers that mount on a wall and that use the wall to create sound are well known. U.S. Pat. No. 3,728,497, issued to Komatsu on Apr. 17, 1973, discloses a typical design. A voice coil is wound on a sleeve affixed to a disk-shaped member having a thick hub with a hole in the center. The sleeve sits in the annular gap of a cylindrical permanent magnet, also having a hole through its center. Vibration of the voice coil is transmitted to the hub through the disk-shaped member. The device is affixed to the wall by a screw that runs through the holes in the magnet and the hub. The device is relatively complex, with a number of spacers, disks and suspension pieces. Since the voice coil is wound on a sleeve, specialized materials and adhesives must be used to withstand the mechanical and thermal stresses that will arise during operation. Some designs also suffer from poor low frequency performance.

A need remained for a device that is simple in design and construction, and which has a minimum of parts. A structure that is rugged and allows the voice coil to withstand large mechanical and thermal stress was also desired, as was a device having acceptable performance at low frequencies. As always, a less expensive structure that is simple to make and use was also desired.

SUMMARY OF THE INVENTION

The general object of the invention is to convert electrical signals into sound energy. This object is achieved by an electrodynamic transducer that uses a fixed voice coil wound on a yoke and separated from a permanent magnet by a spacer. Applying an electric current to the voice coil creates a magnetic field that causes the permanent magnet to move. When the device is mounted against a wall, a table top or another flat surface, the surface becomes a sounding board for the magnet's vibrations.

Another object of the invention is to minimize the total number of parts, especially moving parts. This object is achieved by the sandwich design of the magnetic assembly and by having the permanent magnet move, instead of the voice coil. The permanent magnet and the spacer are the only parts designed to move.

Still another object of the design is to create a device that is rugged and durable. This object is also achieved by the use of a sandwich design and a fixed voice coil/moving magnet arrangement. Since the voice coil is permanently wound on the yoke, the voice coil is better protected against mechanical and thermal stresses than the conventional design having the voice coil wound on a bobbin or former. Further, all of the main elements of the device contact each other over a large surface area, reducing contact stresses and further strengthening the overall structure.

Another object of the invention, similar to rugged design, is to allow the device to operate in hostile environments, possibly even underwater. This object is also achieved by the design of the transducer. The transducer parts can be coated with corrosion resistant materials, without significantly affecting operation, and airtight terminals can be used to connect the wire carrying the signal to the device.

The above, as well as additional objects, features, and advantages of the invention will become apparent in the following detailed description.

DESCRIPTION OF THE PREFERRED EMBODIMENT

Figure 1:
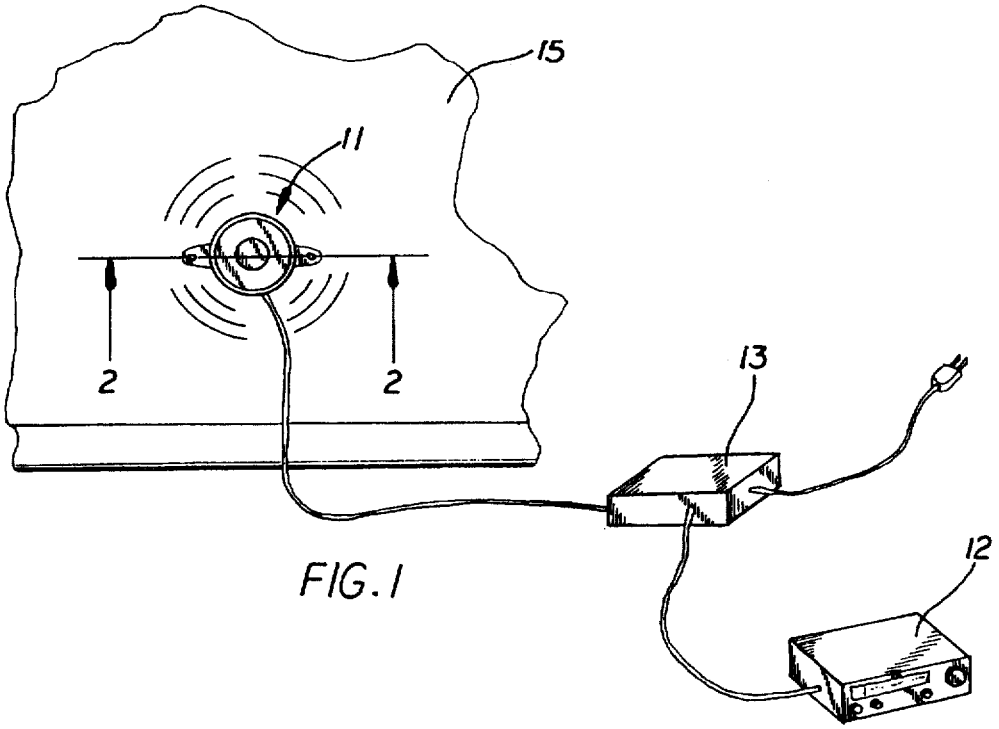
FIG. 1 is a front elevation of a sound transducer according to the invention as it appears when installed, showing its relationship to the other components of a sound reproduction system.
Figure 2:
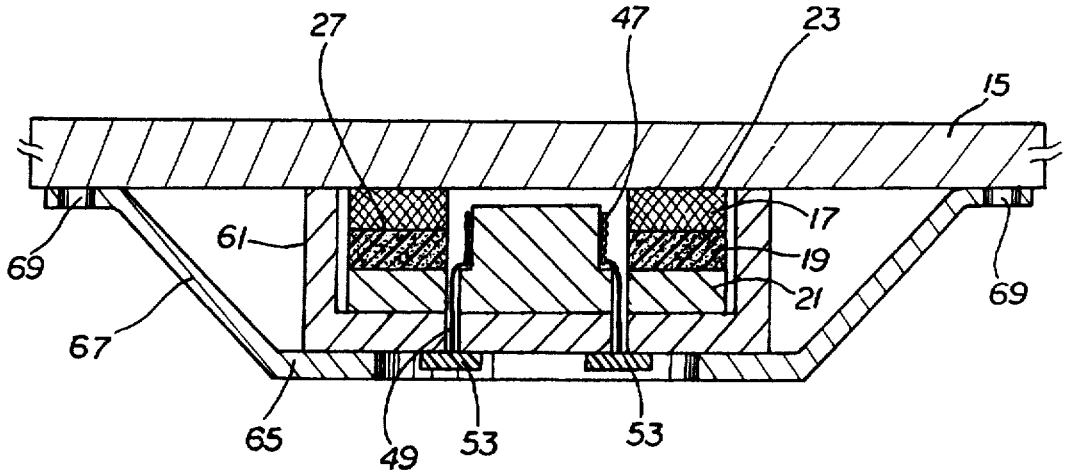
FIG. 2 is a cross sectional view of the sound transducer as seen along lines 2—2 in FIG. 1.
Figure 3:
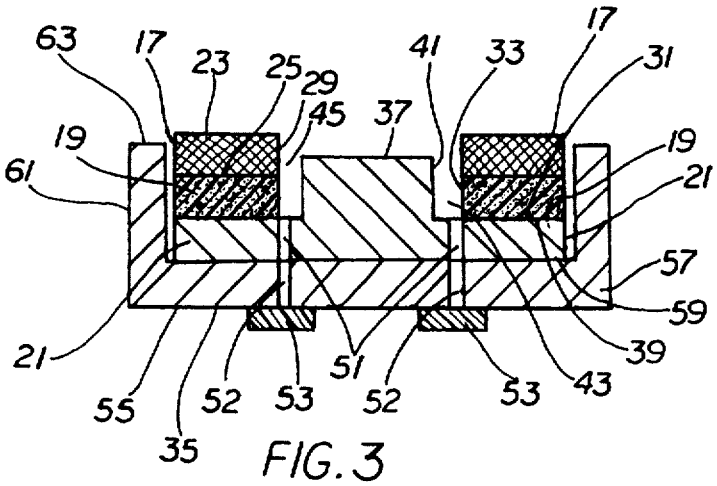
FIG. 3 is a detail of the permanent magnet, the spacer, the yoke and the frame as shown in FIG. 2.
Figure 4:
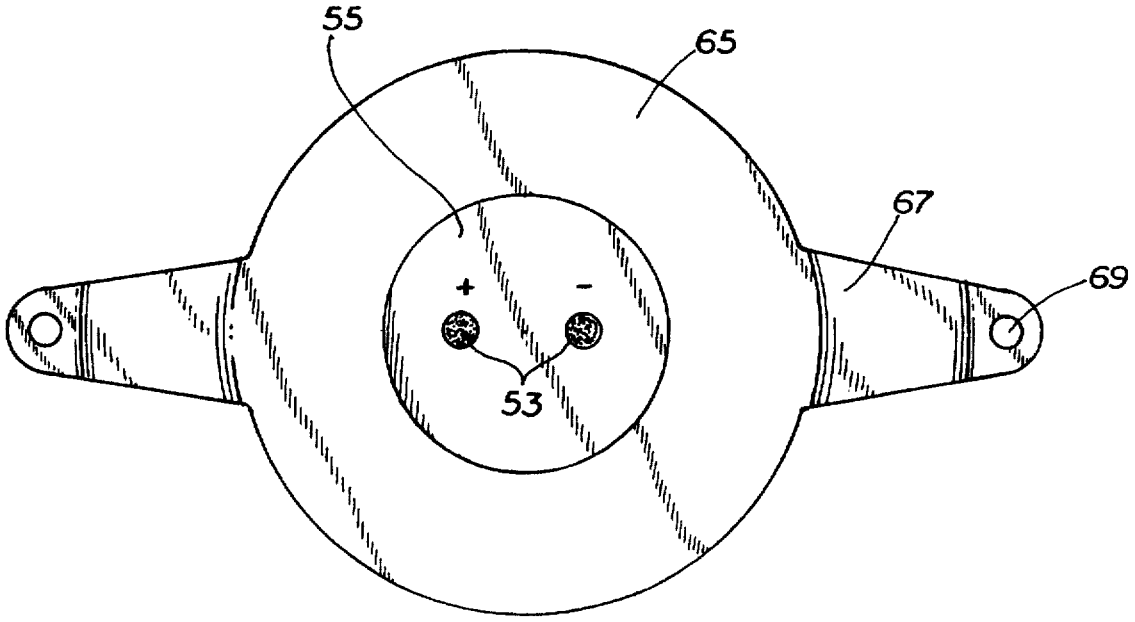
FIG. 4 is a front elevation of a sound transducer according to the invention.

FIG. 1 shows the preferred embodiment of the sound transducer 11 of the invention, installed as part of a sound reproduction system. The device performs the final function of converting electrical signals from a receiver 12 and an amplifier 13 into mechanical motion that is transmitted to the wall 15 to create sound energy. The details of construction of the sound transducer 11 are depicted in FIGS. 2 and 3.

The core of the sound transducer consists of a sandwich made up of a permanent magnet 17, a spacer 19 and a yoke 21. The permanent magnet 17 is an annular disk about 2 inches (50 millimeters) in diameter and 0.3 inches (7 millimeters) thick, made of ceramic ferromagnetic material. The permanent magnet rear face 23 contacts the wall 15 during operation, and the permanent magnet front face 25 is fixed to the rear face 27 of the spacer 19 with adhesive. A circular hole 29 about one inch (25 millimeters) in diameter extends through the center of the permanent magnet 17. The exact dimensions and material used for the permanent magnet 17 may be varied for the particular use.

The spacer 19 is an annular disk with roughly the same outside diameter as the permanent magnet 17. The rear face 27 of the spacer 19 is attached to the permanent magnet 17 with adhesive. The front face 31 of the spacer 19 is similarly attached to the yoke 21 with adhesive. The spacer 19 has a hole 33 coaxially aligned with the hole 29 in the permanent magnet 17, the diameter of the hole 33 being slightly greater than that of the hole 29 in the permanent magnet 17. This is to allow the spacer 19 to expand laterally when compressed as will be described below. The spacer 19 is constructed of a material that is both resilient and highly flexible; such as foam rubber or solid elastomeric rubber.

The yoke 21 is made of ferromagnetic material, such as iron or steel, and has a disk 35 and a center pole 37. The outside diameter of the disk 35 is roughly equal to that of the spacer 19 and the permanent magnet 17. The thickness of the disk 35 should be sufficient to keep the yoke rigid during operation.

The center pole 37 is a cylinder extending from the rear face 39 of the yoke 21 and coaxially aligned with the disk 35. The diameter of the center pole 37 is smaller than the spacer hole 33 and the permanent magnet hole 29. An annular air gap 41 is thus defined between the center pole 37 and the two holes 29 and 33, the front portion 43 of the air gap being formed between the center pole 37 and the spacer 19 and the rear portion 45 being formed between the center pole 37 and the permanent magnet 17.

A voice coil 47 made of copper wire 49 is wound on the center pole 37, so that it will fit within the air gap 41. The dimensions of the air gap 41 can be varied to allow for the particular wire thickness and number of layers of wire 49 in the voice coil 47. The wire thickness and total length may be varied, although conversion efficiency is improved with a greater number of turns of wire 49. Also, it is recommended that the wire thickness and length be designed to yield a voice coil impedance within the range of four to eight ohms, in order to make the transducer load compatible for use with a typical audio amplifier 13. The voice coil 47 should preferably be wound almost entirely in the air gap's front portion 43, although some of the voice coil 47 may extend into the rear portion 45 of the air gap 41. Each end of the wire 49 passes through a hole 51 in the disk 35 and attaches to a terminal 53 of the type commonly used for speaker connections.

A frame 55 having a flat base 57 is fixed to the front face 59 of the yoke 21. The side 61 of the frame 55 extends from the base 57 rearward with the side's rear edge 63 positioned so that the rear face 23 of the permanent magnet 17 extends slightly beyond the rear edge 63 of the frame side 61. The offset, or distance the permanent magnet 17 extends beyond the frame side 61, is dependent on the material used for the spacer 19 and the desired seating force used to hold the permanent magnet 17 against the wall 15 when installed.

The frame side portion 61 is shown as a ring that completely surrounds the permanent magnet 17, the spacer 19 and the yoke 21. Other configurations may be used however, such as a number of evenly spaced arc-shaped legs, as long as the necessary structural strength and the offset between the side's rear edge 63 and the rear face of the permanent magnet 17 are maintained. The frame side 61 should be made of nonmagnetic material so as not to affect the movement of the permanent magnet 17.

A mounting bracket 65 is fixed to the frame 55. The mounting bracket 65 and frame 55 may also be manufactured as a single piece. The mounting bracket 65 has a pair of arms 67 extending outward and rearward from the frame 55 and terminating in mounting holes 69 that allow the transducer to be mounted to the wall 15 with screws (not shown). The mounting holes 69 should be coplanar with the frame rear edge 63, with allowance made for any bending of the arms 67 which may result during installation. The transducer 11 may be installed with the arms oriented either vertically or horizontal. If the arms are horizontal, the length of the arms 67 may be varied by the manufacturer in order to locate the mounting holes 69 over adjacent wall studs (not shown) for more secure attachment to the wall 15.

When installed, the frame 55 will be biased toward the wall 15 by the screws, so that the rear edge 63 of the frame side contacts the wall 15. As a result, the spacer 19 will be compressed by the amount of the offset between the permanent magnet rear face 23 and the frame side's rear edge 63. Depending on the material used for the spacer 19, this will also cause the spacer hole 33 to decrease in diameter due to lateral expansion of the spacer. The uncompressed diameter of the spacer 19 should be made greater than the diameter of the permanent magnet hole 17 to compensate for this effect. The center pole 37 should not contact the wall 15 when the transducer 11 is installed.

While the device is shown installed on a wall, other flat surfaces are equally feasible. One such application would comprise a pair of transducers adapted for use in headphones for the deaf, who would then sense the magnet vibrations directly. It is also possible, with modifications, to use the transducer for more unconventional applications. Some uses envisioned are the placement of the transducer against the body for direct transmission of vibration to the skeleton, and mounting the device on the bottom of a swimming pool for underwater sound.

The sound transducer of the invention has several advantages over the prior art. The voice coil does not need to move relative to the center pole, which results in several advantages. Firstly, there is no need for voice coil formers or bobbins using special high temperature adhesives and materials, since the voice coil can be wound directly on the center pole. There is also no need for the fragile, complex and expensive suspension parts that are required to center and hold the voice coil and diaphragm of conventional designs. Finally, the center pole and voice coil are in intimate contact, resulting in excellent heat dissipation for the voice coil. The claimed invention also allows the use of higher gauge wire than conventional designs. The design is therefore extremely rugged and durable. The magnet creates a large contact area with the wall, which provides better transmission of low frequencies to the support surface. The sound transducer can be constructed simply and inexpensively. It has no complicated moving parts, and can be easily installed and removed.

The invention has been shown in only one embodiment. It should be apparent to those skilled in the art that the invention is not so limited, but is susceptible to various changes and modifications without departing from the spirit of the invention.

What is claimed is:

1. A sound transducer for converting electrical signals into mechanical motion, operating in conjunction with a flat support surface, the sound transducer comprising:

a yoke having a disk, a center pole, a rear face and a front face;

a resilient flat spacer having a rear face and a front face, the front face of the spacer being adhesively attached to the rear face of the yoke, the spacer having a hole passing through the spacer;

a permanent magnet having a rear face and a front face, the front face of the permanent magnet being attached to the rear face of the spacer, the permanent magnet having a hole passing through the magnet, the hole in the permanent magnet being aligned with the hole in the spacer;

the center pole of the yoke extending into the holes in the spacer and the permanent magnet, the center pole and the hole in the spacer forming a front portion of an air gap, the center pole and the hole in the permanent magnet forming a rear portion of an air gap;

a voice coil wound on the center pole and extending through the front portion of the air gap and partially into the rear portion of the air gap;

a frame member having a flat base and a side portion having a rear edge, the base being fixed to the front face of the yoke, the rear edge of the side portion of the frame member making contact with the flat support surface, the rear face of the permanent magnet being biased against the flat support surface when the rear edge of the side portion of the frame member makes contact with the flat support surface; and a support bracket fixed to the frame member for affixing the frame member against the flat support surface.

2. A sound transducer as recited in claim 1, wherein the spacer is made of a resilient flexible material.

3. A sound transducer as recited in claim 1, further comprising terminals for connecting the voice coil to a wire cable connected to an electrical signal source.

4. A sound transducer as recited in claim 1, wherein the mounting bracket further comprises a plurality of arms extending from the frame and ending in mounting holes allowing the sound transducer to be mounted to the support surface using screws.

* * * * *